US005943987A

United States Patent [19]

Fischer

[11] Patent Number: 5,943,987

[45] Date of Patent: Aug. 31, 1999

[54] RECIPROCATING PISTON ENGINE WITH ADJACENT CYLINDERS IN THE CRANKSHAFT DIRECTION IN AN ENGINE CASE

[75] Inventor: Gert Fischer, Feldafing, Germany

[73] Assignee: Bayerische Motoren Werke Aktiengesellschaft, Germany

[21] Appl. No.: 08/894,178

[22] PCT Filed: Feb. 14, 1996

[86] PCT No.: PCT/EP96/00631

§ 371 Date: Oct. 22, 1997

§ 102(e) Date: Oct. 22, 1997

[87] PCT Pub. No.: WO96/25587

PCT Pub. Date: Aug. 22, 1996

[30] Foreign Application Priority Data

Feb. 14, 1995 [DE] Germany ..... 195 04 890

[51] Int. Cl.[6] ..... F01B 9/02; F02B 75/24

[52] U.S. Cl. ..... 123/55.5; 123/197.4

[58] Field of Search ..... 123/55.5, 55.7, 123/197.4

[56] References Cited

U.S. PATENT DOCUMENTS

| | | | |
|---|---|---|---|
| 848,635 | 4/1907 | Comstock | 123/55.5 |
| 908,605 | 1/1909 | Olin | 123/55.5 |
| 1,233,621 | 7/1917 | Twombly | 123/188.1 |
| 1,866,702 | 7/1932 | Gehres | 74/44 |
| 2,302,851 | 11/1942 | Geiser | 123/51 |
| 2,367,963 | 1/1945 | Ricardo | 123/56 |
| 2,513,514 | 7/1950 | Poage | 74/50 |
| 3,195,420 | 7/1965 | Johannsen | 92/74 |
| 3,386,429 | 6/1968 | Trammell, Jr. | 123/197 |
| 3,968,323 | 7/1976 | Blanchet | 174/135 |
| 4,559,686 | 12/1985 | Kessler | 29/156.5 |
| 4,794,887 | 1/1989 | Valentine | 123/56 AC |
| 4,884,536 | 12/1989 | Neale | 123/197 AC |
| 5,161,493 | 11/1992 | Ma | 123/90.17 |
| 5,327,863 | 7/1994 | Downton et al. | 123/197.4 |
| 5,331,926 | 7/1994 | Vaux et al. . | |
| 5,727,513 | 3/1998 | Fischer | 123/197.4 |

FOREIGN PATENT DOCUMENTS

| | | |
|---|---|---|
| 271755 | 2/1912 | Germany . |
| 25 19 908 A1 | 11/1976 | Germany . |
| 41 08 311 A1 | 9/1992 | Germany . |
| 41 42 385 A1 | 6/1993 | Germany . |
| 401029623 | 1/1989 | Japan . |
| 1060372 | 3/1967 | United Kingdom . |
| 2038937 | 7/1980 | United Kingdom . |

*Primary Examiner*—Henry C. Yuen
*Assistant Examiner*—Arnold Castro
*Attorney, Agent, or Firm*—Evenson, McKeown Edwards & Lenahan, P.L.L.C.

[57] ABSTRACT

A reciprocating drive system in a reciprocating piston engine with adjacent cylinders in the crankshaft direction in an engine case is particularly directed to an internal-combustion engine which comprises a reciprocating drive system for the reciprocating pistons with a hypocycloidal straight-line mechanism. The straight-line mechanism has a guide element cooperating with guide surfaces arranged on the engine case. For simplifying the system as much as possible, the guide element of the straight-line mechanism is arranged between the piston rods for reciprocating pistons of cylinders adjacent in a bank and is optionally adjustable.

11 Claims, 4 Drawing Sheets

RECIPROCATING PISTON ENGINE WITH ADJACENT CYLINDERS IN THE CRANKSHAFT DIRECTION IN AN ENGINE CASE

This application claims the priority of PCT/EP96/00631 and 195 04 890.3, the disclosures of which are expressly incorporated by reference herein.

BACKGROUND AND SUMMARY OF THE INVENTION

The present invention relates to a reciprocating piston engine having cylinders adjacent in the crankshaft direction in an engine case, particularly an internal-combustion engine, comprising a reciprocating drive system for reciprocating pistons which, by way of piston rods by means of a hypocycloidal straight-line mechanism, are in a driving connection with reciprocating and guide eccentrics which are rotationally movable on a crankshaft, a guide element of the straight-line mechanism cooperating with guide surfaces arranged on the engine case.

GB-1 060 372 describes an embodiment of a reciprocating piston engine having diametrically arranged cylinder pairs whose parallel axes orthogonally intersect the axis of rotation of the crankshaft. This reciprocating piston engine is an internal-combustion engine combined with a reciprocating piston compressor. This known engine comprises a reciprocating drive system with a hypocycloidal straight-line mechanism which comprises eccentrics combined with a crankshaft and non-rotatably connected with one another. Both piston rods, which connect opposing pistons in diametrical cylinders, are jointly in a driving connection with a tube-type reciprocating eccentric constructed of two parts, in whose two end areas one guide eccentric respectively is arranged which has a guide element guided on the engine case side in a straight line in a slidably movable manner.

Cylinder tubes, which in addition are used for the linear guiding of the reciprocating pistons and are arranged to be guided coaxially to the reciprocating pistons in the engine case and, for the slidably movable guiding are in a driving connection with the tube-type reciprocating eccentric are particularly disadvantageous with respect to this known reciprocating drive system. This arrangement results in a reciprocating piston engine which has a long dimension in the longitudinal direction of the crankshaft and disadvantageously large bearing distances for the crankshaft in the engine case.

Another disadvantage is the high-expenditure and complicated construction of this known reciprocating drive system with the hypocycloidal straight-line mechanism with a three-disk eccentric mounted freely rotatably on a crankshaft reciprocating pin and integrally formed.

DE-PS 271 755 describes an embodiment of an internal-combustion engine with a reciprocating piston with diametrically arranged cylinder pairs whose parallel axes extend in a transverse plane with respect to the axis of rotation of the crankshaft. In the case of a reciprocating drive system with a hypocycloidal straight-line mechanism, this arrangement permits the linking of the parallel piston rods to a single guide ring of a reciprocating eccentric non-rotatably arranged in the center between pinions of Cardan's circle pairs.

Although this known arrangement with the hypocycloidal straight-line mechanism results in a reciprocating piston engine which has a short construction in the longitudinal direction of the crankshaft and has relatively short bearing distances of the crankshaft, the low stability of this reciprocating drive system with its toothing is a disadvantage.

Further, DE-A 25 19 908 describes a hypocycloid reciprocating piston engine which, in the plane of the axis of rotation of the crankshaft, has cylinder pairs arranged in an adjacent manner in the direction of the crankshaft, between whose connecting rods another orthogonally directed cylinder pair is provided as the hypocycloidal straight-line mechanism. This cylinder pair has pistons oscillating in additional cylinders of the reciprocating piston engine which are used as guide elements so that this crosswise arrangement of cylinder pairs results in a disadvantageously large-sized internal-combustion engine.

In another embodiment of the species shown in DE-A 25 19 908, instead of guidance by a cylinder pair, a sliding block cooperates with the guide eccentric provided centrally between the piston rods. The block is guided linearly by straight-line mechanisms, rigidly mounted in the engine housing orthogonally to the piston rods. The disadvantage of this arrangement is that the sliding block tends to jam in every TDC range of each piston and this cannot be completely eliminated even by maintaining large parts tolerances and expensive measures.

An object of the present invention is to provide a kinematically advantageous hypocycloidal straight-line mechanism centrally between parallel piston rods in which such straight-line mechanism together with additional features of the present invention permit a compact design with relatively low weight in a surprisingly simple fashion.

This object has been achieved by providing that, on a guide eccentric arranged between the piston rods for reciprocating pistons of cylinders adjacent in banks, a single guide element is used for the straight-line motion of the two piston rods.

The arrangement according to the present invention reduces to a minimum in an advantageous manner the free reciprocating pin length of the crankshaft for two synchronously provided piston pairs. This minimum is the result of the cylinder spacing plus twice half the piston rod thickness. As a result, the webs of the crankshaft can be arranged closely adjacent to the respective piston rod and can be equipped with compensating masses for the reciprocating pistons and piston rod relative to the axis of rotation of the crankshaft, similar to the advantageous development known from the above-mentioned DE-PS 271 755.

The use of a Watt-type control arm suggested in DE-A 41 08 311 as the guide element of the hypocycloidal straight-line mechanism, with a connecting rod mounted between the piston rods on the single guide eccentric makes it possible in another embodiment to equip the swing arms of the guide eccentric, in at least one of its linking points, with an adjusting eccentric arranged rotatably and fixably relative to the connecting rod and/or to the engine case, as the device for compensating dimensional tolerances. After the mounting of the reciprocating drive system, in the center position of the connecting rod, this adjusting eccentric is rotated first in one direction until a resistance occurs, is then rotated in the opposite direction until the next resistance occurs and is finally fixed by taking the mean amount approximately between both resistance positions. While the connecting rod of the Watt-type control arm is encapsulated in the engine case, the engine-case-side linking points of the swivel arms are advantageously equipped with adjusting eccentrics which thereby become accessible, for example, for an automatic adjustment in a series production of the reciprocating piston engine.

For achieving a simple mounting of the guide eccentric in the one piece connecting rod of the Watt-type control arm used as the guide element, the guide eccentric is formed of parts which can be connected in the axial reciprocating-pin direction. A reciprocating eccentric as well as a compensating mass relative to the axis of the crankshaft reciprocating pin is arranged on each part on the piston rod side for obtaining a simpler construction.

The simple design is advantageously reinforced in another embodiment of the present invention by specially designed reciprocating eccentrics being mounted on the guide eccentrics, each in a releasable nonrotatable connection. The need for a nonrotatable connection of the eccentric with the crankshaft reciprocating pin is thereby eliminated and produces a freely rotatable arrangement of the kinematically functionally connected three-disc eccentric in an axially advantageously shorter configuration.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 2:
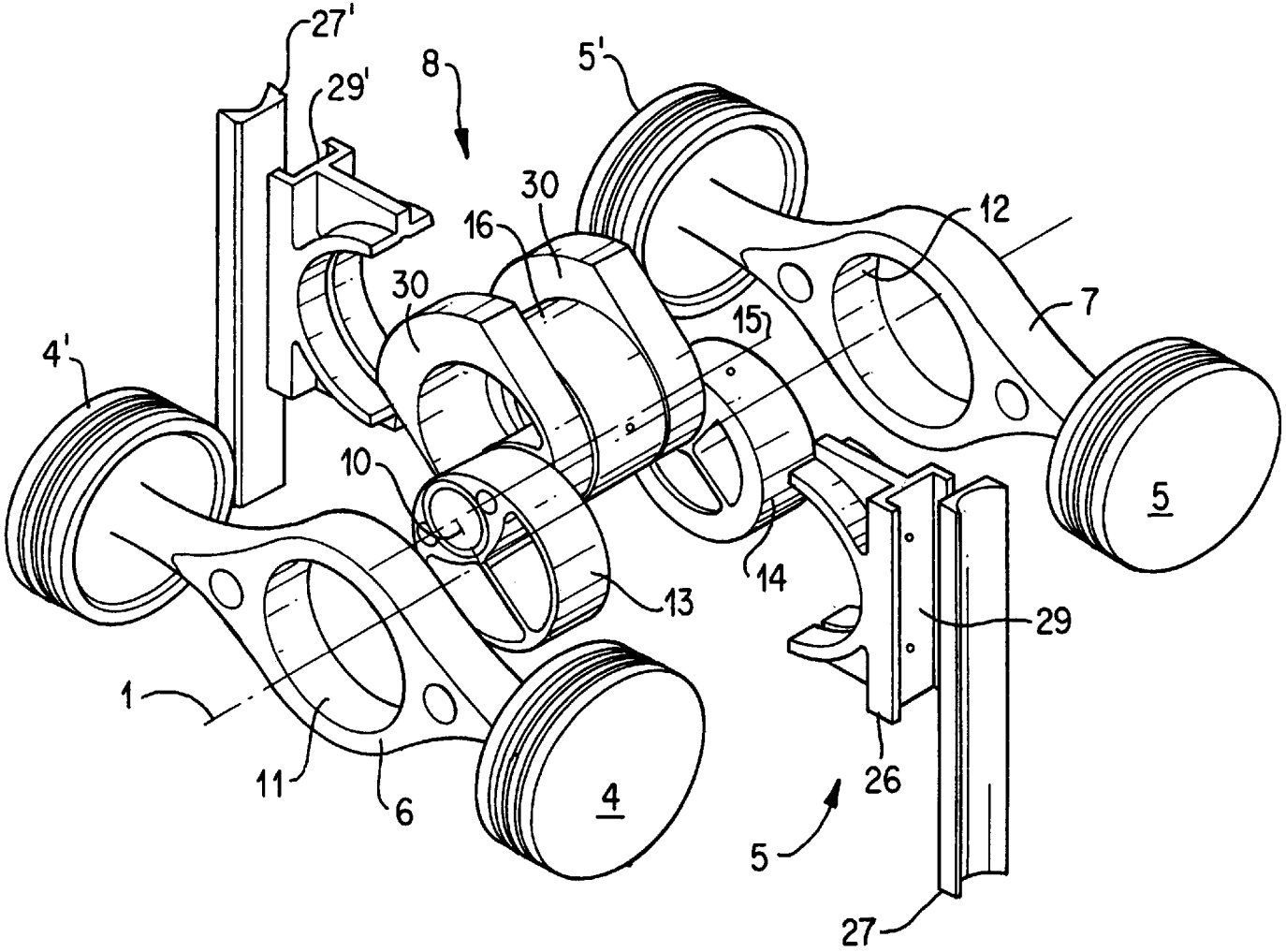
FIG. 2 is a perspective view of another reciprocating drive system of a reciprocating piston engine having a sliding block of a hypocycloidal straight-line mechanism which interacts in the center between piston rods with a single guide eccentric.
Figure 3:
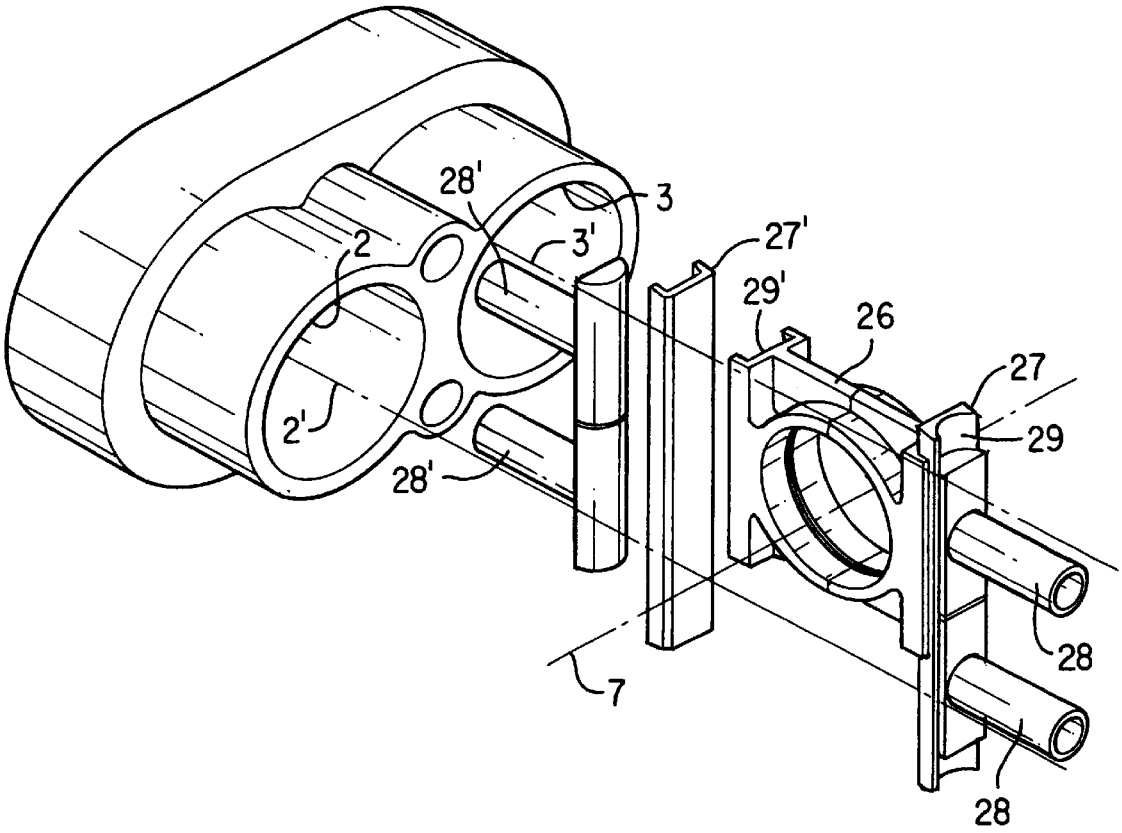
FIG. 3 is a perspective view of the connecting link guide in connection with one of two diametrically arranged cylinder housings of the reciprocating piston engine.

An engine case, which is divided in a vertical plane of the axis of rotation of the reciprocating piston engine crankshaft 1 comprises according to FIG. 3 diametrically arranged pairs of cylinders 2, 3 whose cylinder axes 2' and 3' orthogonally intersect the axis of rotation 1 of the crankshaft 1. Mutually opposed reciprocating pistons 4, 4' and 5, 5' in the diametrically arranged pairs of cylinders 2, 3, according to FIG. 2, are connected with one another by way of piston rods 6, 7. For the oscillating arrangement of the piston pairs 4, 4' and 5, 5' by way of the respective pistons rods 6, 7, a reciprocating drive system 8 is provided which has a hypocycloidal straight-line mechanism 9. The reciprocating drive system 8 designated generally by numeral, which in principle has the same construction for both embodiments of FIGS. 1 and 2, comprises a crankshaft which is symbolized by a stepped line 10. The piston rods 6 and 7, which oscillate in the same direction along the respective cylinder axes 2' and 3', have recesses 11, 12 arranged in the center for the rotationally movable accommodation of one reciprocating eccentric 13, 14 of the respective hypocycloidal straight-line mechanism designated generally by numeral 9.

A line 15 of the crankshaft 10 parallel to the axis of rotation 1 of the crankshaft symbolizes a reciprocating pin. Reciprocating eccentrics 13, 14, which are disposed in mutually parallel piston rods 6 and 7, are rotationally movably arranged on this reciprocating pin 15, specifically in its exterior end areas. As the result of the piston pairs 4, 4' and 5, 5' oscillating in the same direction, the reciprocating eccentrics 13, 14 are arranged in the same direction on the common reciprocating pin 15.

In the center between these reciprocating eccentrics 13, 14, the hypocycloidal straight-line mechanism 9 also comprises a guide eccentric 16 which is rotationally movably disposed on the reciprocating pin 15, is diametrically arranged with respect to the reciprocating eccentrics 13, 14 and is in a non-rotatable connection with the reciprocating eccentrics 13, 14. This guide eccentric 16 cooperates with a guide element designated generally by numeral 17 of a straight-line mechanism 9 arranged between the piston rods 6, 7 for pairs of the reciprocating pistons 4, 4' and 5, 5' of the cylinders 2, 3 which are adjacent in a bank. Thereby, the guide element 17, which is essentially guided in a straight line transversely to the moving directions of the pistons rods 6 and 7, in principle, cooperates with guide surfaces arranged on the engine case.

Figure 1:
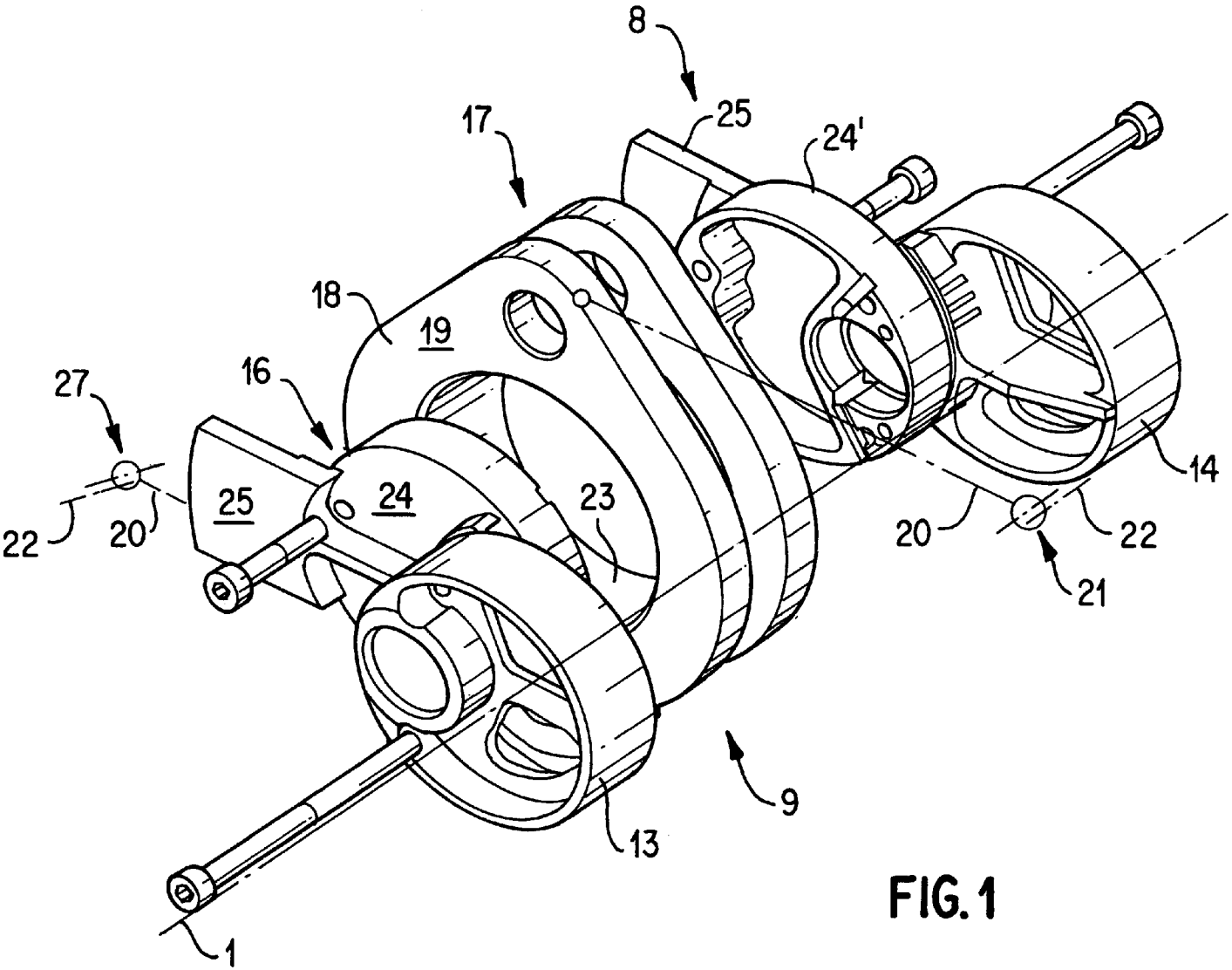
FIG. 1 is a perspective view of a segment of a reciprocating drive system of a reciprocating engine having a Watt-type control arm in a hypocycloidal straight-line mechanism.

In the first embodiment according to FIG. 1, the hypocycloidal straight-line mechanism 9 of the reciprocating drive system 8 is combined with a Watt-type control arm 18 whose connecting rod 19 is arranged as a guide element 17 between the piston rods 6, 7 and is disposed on the guide eccentric 16. The connecting rod 19 is linked to the engine case by way of schematically illustrated swing arms 20. Preferably the swing arms 20 are each equipped in their case-side linkage points 21 with an adjusting eccentric 22 which is rotatably and fixably arranged relative to the engine case and is used as the device for compensating dimensional tolerances. After the mounting of the reciprocating drive system 8 in the engine case these adjusting eccentrics 22 are successively rotated first in one direction until a rotational resistance occurs; are then rotated in the opposite direction until the next resistance occurs and are finally fixed approximately between the two resistance positions by taking the mean position. During this adjustment, the connecting rod 19 is arranged in its center position, in which the center of the bore 23 receiving the guide eccentric 16 is essentially aligned with the axis of rotation 1 of the crankshaft or, on the basis of dimensional tolerances, is spaced slightly parallel thereto. The adjusting eccentrics 22, by way of the bearing plays existing in the reciprocating drive system 8, allow an adjustment of the connecting rod 19 to be found for avoiding jamming in the reciprocating drive system, along the entire guide lift of the connecting rod 19 between its extreme positions.

For mounting the connecting rod 19 on the guide eccentric 16 in the embodiment of FIG. 1, latter is formed of parts 24, 24' which can be connected in the axial reciprocating pin direction. For achieving a simpler construction, one of the reciprocating eccentrics 13 or 14 as well as a compensating mass 25 relative to the axis of the crankshaft reciprocating pin 15 is arranged on each part 24, 24' on the piston rod side.

In the further embodiment illustrated in FIGS. 2 and 3, the guide eccentric 16 of the hypocycloidal straight-line mechanism 9 is combined with a guide element 17 guided in a straight line in a slidably movable manner on the engine case side between the piston rods 6, 7. The guide element 17 is configured as a sliding block 26 constructed with parallel guide surfaces. This sliding block 26 cooperates with separate guide strips 27, 27' which, for compensating dimensional tolerances, are arranged to be displaceable transversely to the guiding direction in/on the engine case. Preferably, the guide strips 27, 27' are arranged to be displaceable by way of pistons 28, 28' which are arranged in the engine case and can be acted upon hydraulically, in which the guide strips 27, 27' are also disposed to be tiltable relative to the pistons 28, 28'. This arrangement according to the present invention achieves an automatic adjustment of the sliding block 26 with its bore center relative to the axis of rotation 1 of the crankshaft 1. When the supporting pistons 28, 28' are connected to the pressure lubrication system of the reciprocating piston engine, an automatic play and compensation adjustment is achieved. The sliding block 26 can also cooperate with the guide strips 27, 27' by roller bearing devices or roller bodies in order to prevent alone or in connection-with the displaceable guide strips 27, 27' a jamming or a selflocking of the straight-line mechanism 9 in an upper dead center range of the pistons 4, 4', 5, 5', particularly in the event of a cold start.

This straight motion of the sliding block 26 along the guide strips 27, 27', which is hydraulically supported according to the present invention, allows, in view of the mounting of the sliding block 26 and the configuration of the guide eccentric 16, the sliding block 26 to be divided in half in the guiding direction parallel to its guide surfaces 29, 29'. As a result, the guide eccentric 16, including the compensating masses 30 arranged in its two face areas, can be constructed in one piece, whereby in a mounting combination with the reciprocating eccentrics 13, 14, a stiff three-disk eccentric combination is achieved.

Within the scope of the invention, instead of the sliding block 26, a roller bearing arranged on the guide eccentric 16 can be provided as another guide element 17 which is in a slidably movable connection by its exterior bearing ring, for example, with the displaceably arranged guide strips 27, 27'.

Figure 1A:
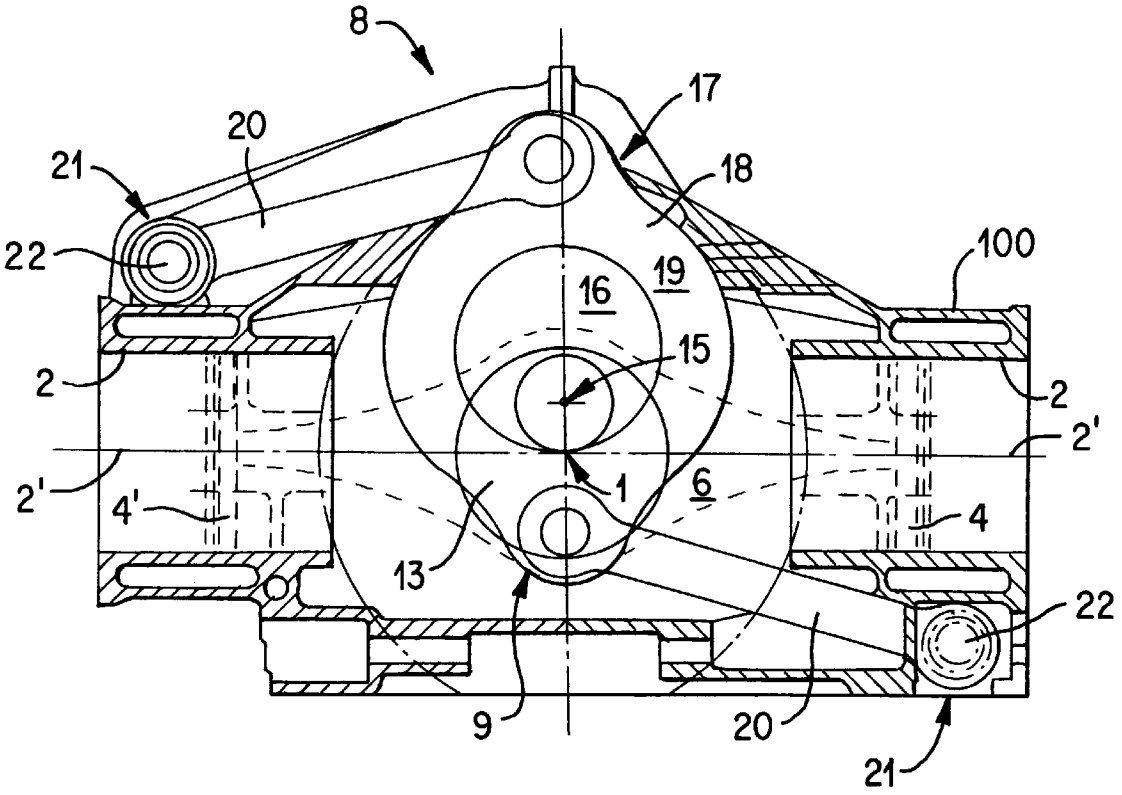
FIG. 1*a* shows the hypocycloidal reciprocating transmission of FIG. 1 in an engine case.

FIG 1*a* shows the hypocycloidal reciprocating transmission 8 of FIG. 1 in an engine case 100. A correspondingly configured engine case applies to the embodiment of the reciprocating transmission 8 according to FIG. 2 with a guide eccentric 16 guided in a straight line by way of a sliding block 26.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A reciprocating piston engine having cylinders adjacent in the crankshaft direction in an internal combustion engine case comprising a reciprocating drive system for reciprocating pistons which, by way of piston rods and a hypocycloidal straight-line mechanism, are in a driving connection with reciprocating eccentrics and a guide eccentric rotationally movably arranged on a crankshaft and arranged between two adjacent piston rods for reciprocating pistons of adjacent cylinders in a bank, wherein the straight-line mechanism has only one guide element arranged to cooperate with spaced guide surfaces on the engine case, and the only one guide element for the straight-line guiding of the two adjacent piston rods, wherein the respective guide element cooperates with separate guide strips arranged to be displaceable transversely in the guiding direction in/on the engine case for compensating dimensional tolerances and the guide strips are arranged to be displaceable by hydraulically acted-upon pistons arranged in the engine case, the guide strips being arranged to be tiltable relative to the pistons.

2. A reciprocating piston engine having cylinders adjacent in the crankshaft direction in an internal combustion engine case comprising a reciprocating drive system for reciprocating pistons which, by way of piston rods and a hypocycloidal straight-line mechanism, are in a driving connection with reciprocating eccentrics and a guide eccentric rotationally movably arranged on a crankshaft, a guide element of the straight-line mechanism cooperating with guide surfaces arranged on the engine case, wherein, on a guide eccentric arranged between two adjacent piston rods for reciprocating pistons of cylinders adjacent in a bank, only one guide element is used for the straight-line guiding of the two adjacent piston rods and, wherein the guide element is a sliding block constructed with parallel guide surfaces, the guide eccentric, including compensating masses arranged in two face areas thereof, is a one-piece construction, and the sliding block is divided in half in the guiding direction parallel to guide surfaces thereof.

3. The reciprocating piston engine according to claim 2, wherein the straight-line mechanism is configured for the static and/or dynamic compensation of dimensional tolerances between the engine case and the reciprocating drive system.

4. The reciprocating piston engine according to claim 3, wherein opposed reciprocating pistons in diametrically arranged cylinder pairs are connected by way of piston rods and are arranged to be driven in the same direction, the guide eccentric is rotationally movably arranged on a reciprocating pin of the crankshaft centrally between two adjacent piston rods and cooperating with the guide element of the hypocycloidal straight-line mechanism, and the guide eccentric is further non-rotatably connected with the reciprocating eccentrics of the straight-line mechanism which are rotationally movably arranged on both sides adjacent on the reciprocating pin and rotationally movably engage in the piston rods.

5. The reciprocating piston engine according to claim 4, wherein the guide eccentric is constructed to be connected in an axial reciprocating pin direction, and the reciprocating eccentric and compensating mass relative to an axis of the reciprocating pin of the crankshaft are arranged on a piston rod side.

6. The reciprocating piston engine according to claim 5, wherein the guide eccentric of the hypocycloidal straight-line mechanism is combined with the guide element guided in a straight line in a slidably movable manner between the adjacent piston rods on the engine case side.

7. Reciprocating piston engine with cylinders adjacent in the crankshaft direction in an engine housing, comprising a reciprocating drive for reciprocating pistons in a driving connection by piston rods with interposition of a hypocycloidal straight-line mechanism, reciprocating and guide eccentrics being mounted on a crankshaft, reciprocating pistons arranged opposite one another in diametrically arranged cylinder pairs connected by the piston rods and driven in the same direction, and a guide eccentric cooperating with a single guide element of the hypocycloidal straight-line mechanism guided in the engine housing being located on a reciprocating pin of an assembled crankshaft centrally between the piston rods, said eccentric being in a nonrotatable connection with the reciprocating eccentrics located adjacent sides of the reciprocating pin and rotatably movably engaging the piston rods, wherein the hypocycloidal straight-line mechanism is combined with a Watt-type control arm having a one-piece connecting rod mounted on the guide eccentric between the piston rods; the guide eccentric of the one-piece connecting rod being formed of parts connectable in an axial reciprocating pin direction, and a reciprocating eccentric as well as a compensating weight are mounted on each of the parts on the piston rod side.

8. The reciprocating piston engine according to claim 7, wherein the reciprocating eccentrics are separately formed and are each mounted on the guide eccentric in a releasable nonrotatable connection, and a three-disk eccentric combination of the straight-line mechanism is freely rotatably movably mounted on the reciprocating pin of the crankshaft as finished.

9. The reciprocating piston engine according to claim 7, wherein swing arms are provided to engage the connecting rod of the Watt-type control arm with articulation and are equipped at at least one articulation point with an adjustable eccentric, located so to be rotatable and fixed relative to at least one of the connecting rod and the engine housing for compensating dimensional tolerances.

10. The reciprocating piston engine according to claim 9, wherein the reciprocating eccentrics are separately formed and are each mounted on the guide eccentric in a releasable nonrotatable connection, and a three-disk eccentric combination of the straight-line mechanism is freely rotatably movably mounted on the reciprocating pin of the crankshaft as finished.

11. The reciprocating piston engine according to claim 9, wherein an adjusting eccentric is provided at each articulation point of the swing arms on a machine housing side with a capability for automatic adjustment.

* * * * *